United States Patent [19]

Cruz

[11] Patent Number: 4,718,717

[45] Date of Patent: Jan. 12, 1988

[54] MULTIPLE PERSON TRAY SEAT

[76] Inventor: Jorge Cruz, P.O. Box 4082, Ocala, Fla. 32678

[21] Appl. No.: 15,211

[22] Filed: Feb. 17, 1987

[51] Int. Cl.[4] ..... A47B 83/02

[52] U.S. Cl. ..... 297/135; 297/153; 297/331; 297/232; 297/487

[58] Field of Search ..... 297/170, 146, 153, 331, 297/232, 135, 487

[56] References Cited

U.S. PATENT DOCUMENTS

| | | | |
|---|---|---|---|
| 930,839 | 4/1908 | Cleary | 297/334 |
| 1,039,647 | 9/1912 | Carter | 297/256 |
| 2,533,527 | 12/1950 | Soltis | 297/331 |
| 2,604,930 | 7/1952 | Dean et al. | 297/170 |
| 2,751,967 | 6/1956 | Sitterley | 297/331 |
| 2,774,411 | 12/1956 | Berlin | 297/331 |
| 3,320,949 | 5/1967 | Hatfield | 297/153 |
| 3,376,587 | 4/1968 | Staron | 297/331 |
| 4,022,136 | 5/1977 | Schott | 297/153 |
| 4,436,339 | 3/1984 | Albers | 297/153 |

*Primary Examiner*—Francis K. Zugel

*Attorney, Agent, or Firm*—Duckworth, Allen & Dyer

[57] ABSTRACT

A high chair bench assembly simultaneously accommodates several children side-by-side on a horizontal bench bottom pivotally connected to a vertical bench back which is attached to a wall. The bench bottom is held in the horizontal position by a support bar pivotally connected at the top of the side of the bench back and which has a keyhole slot brought over a stud located at the front of the side edge of the bench bottom. The bottom is lowered to a vertical stowage position by removing the keyhole slot from the stud. Each seating place is provided with back and bottom cushions as well as a safety belt. Trays are attached at independently selectable heights above the brackets into vertical perforated tracks located at the sides of each seating place. The trays are secured by an adjustable tension tie releasably connecting the front of each tray to an adjacent bench bottom location.

20 Claims, 4 Drawing Figures

MULTIPLE PERSON TRAY SEAT

This invention relates to a multiple person tray seat, such as a high chair bench for seating several children, with an eating tray or utility surface presented at each seating place.

BACKGROUND OF THE INVENTION

Tray seats are common in households, nurseries, day-care centers and eating establishments to elevate and restrain children during eating, coloring and other seated activities. Trays or other utilitarian flat surfaces are provided on such chairs in convenient positions for use by the seated occupant. Typically, the tray takes the form of an eating tray that together with the seat back and seat bottom of the chair completely surrounds and confines the child during eating, to keep the child seated and to prevent food from spilling. Frequently, chairs such as these are also fitted with safety belts.

Chairs used by children also take the form of play desks which have chairs attached centrally or peripherally to a work surface for similar accommodation of children. Tray seats also exist for the accommodation of adults, such as for use in hospitals and in facilities for the treatment of the handicapped. Also, various tray seats in the form of chairs with pull-up study surfaces are known for use by pupils in school classrooms and study halls. Another type of tray seat used by passengers in airplanes has a tray folded flat against the back of a seat for pull down by the passenger sitting in back of the seat. A variation of airplane passenger seat has a tray that folds out of one arm rest across the occupant's lap. A second variation has slots at the front of each armrest to receive a snapped-in tray.

Tray seats of the type to which the present invention relates tend to be bulky structures. The common household high chair, for example, has a broad base to prevent its toppling over and, though foldable to some extent, occupies considerable space even in its collapsed folded configuration. In nurseries, day-care centers and other multiple children settings, conventional free-standing high chairs are particularly difficult to manage because of their bulk. Furthermore, stacking many such chairs for storage in closets or against walls adjacent a child play area presents a safety hazard to children who may accidentally topple them. Leaving them unfolded near a play area also presents a hazard and, moreover, reduces the space available for playing.

A number of variations of portable high chairs exist that can be supported on tables or placed for support over chairs. Such devices tend, however, to be too flimsy for nursery or day-care settings and take too long to set up in multiple children situations.

Conventional tray seats usually present a tray to the user at a single elevation above the seat bottom. This is a problem especially in children's high chairs wherein the trays tend to be too high for the younger infants and too low for the older toddlers.

SUMMARY OF THE INVENTION

It is an object of the present invention to overcome the above and other drawbacks of the prior art by providing a multiple person tray seat for attachment to a wall or other support that can readily and conveniently accommodate several seated persons in a single unit.

It is another object of the present invention to provide a multiple person tray seat for attachment to a wall that folds flatly against the wall for stowage, without obstructing floor space when not in use.

It is a still further object of the present invention to provide a multiple person tray seat having a plurality of seating places and having means at each place for receiving a tray at any independently selected one of a plurality of elevations above the seat.

In one aspect of the invention, a multiple person tray seat includes a wall-mounted seat back to which is pivotally connected a seat bottom for movement between an operational position at right angle to the seat back and a storage position against the wall. The seat has a number of seating places to accommodate several people simultaneously, and means is included for attaching a tray at each seating place.

In another respect of the invention, the elevation of the tray at each seating place is individually adjustable to accommodate the height and physical dimensions of the occupant.

In a preferred embodiment of seat, described in greater detail below as an example of one implementation of the invention a high chair type structure is provided for the simultaneous convenient accommodation of several children. Such a structure is particularly adapted for mounting on the wall of a nursery or day-care center, and includes a bench back attached vertically on the wall and to the base of which is hingedly connected a bench bottom. The back and bottom are each outfitted with cushions set apart in spaced positions to serve as the backrests and bottom cushions of several side-by-side seating places on the bench. In its operational position, the bench bottom is at a right angle to the bench back and is held in that position by a diagonal support member that connects the back to the bottom. For stowage, the support member is disengaged to allow the bottom to swing down to a flat vertical position against the wall below the back. Trays, with cutouts to go around the front of the seated children, are recieved by means of brackets into standards or tracks mounted vertically on the bench back along each side of the back cushions of each seating place. The height of which the tray is received at each place is individually adjustable by moving the brackets of that tray up or down to fit into different openings on the tracks. A tie is provided to connect the front of each tray to an adjacent point under the bench bottom to make it more difficult for the tray brackets to be lifted out of the tracks by the child occupant.

BRIEF DESCRIPTION OF THE DRAWINGS

Embodiments of the invention have been chosen for purposes of illustration and description, and are shown in the accompanying drawings, wherein.

Throughout the drawings, like elements are referred to by like numerals.

DESCRIPTION OF THE PREFERRED EMBODIMENTS

Figure 1:
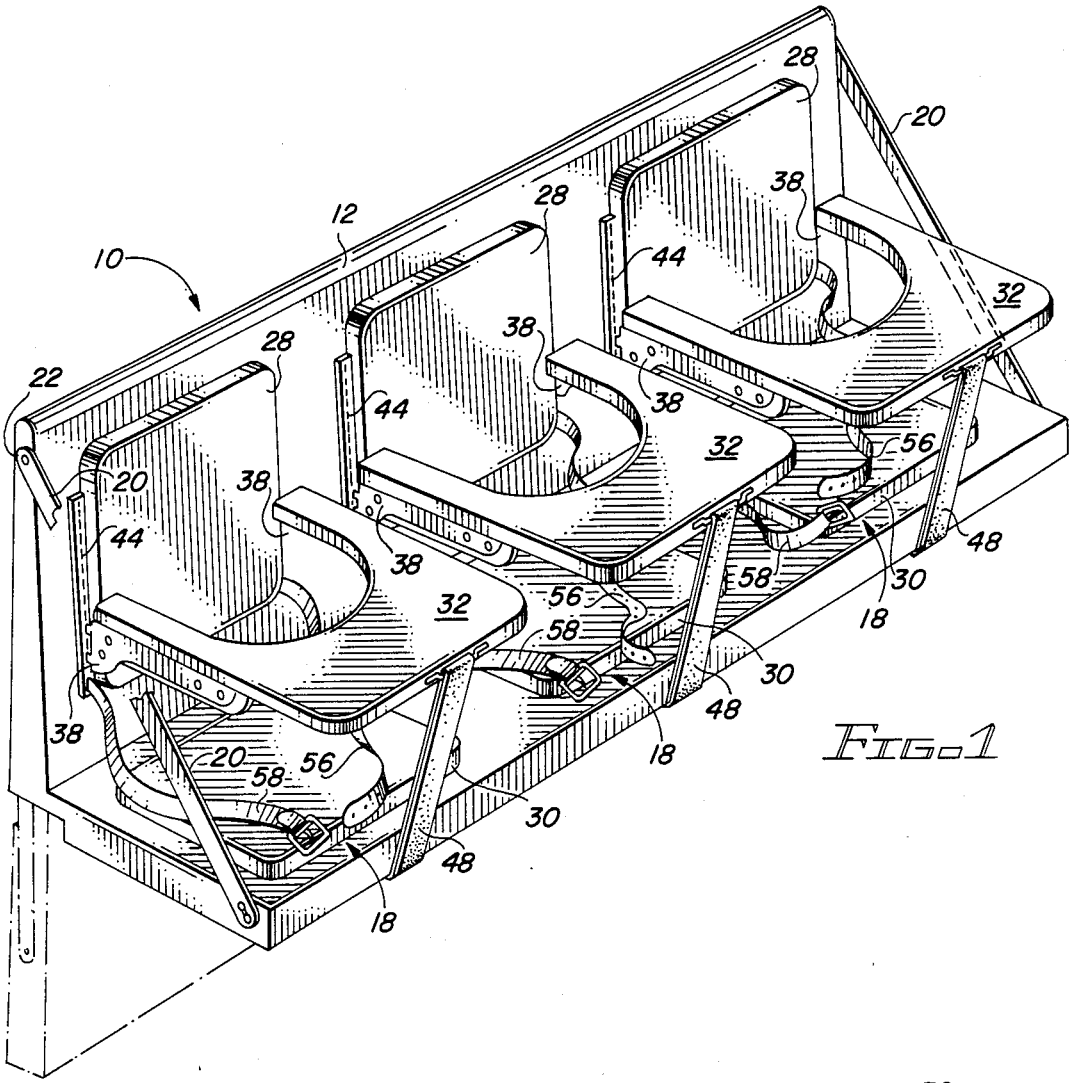
FIG. 1 is a perspective view of a high chair bench assembly in accordance with the present invention.
Figure 2:
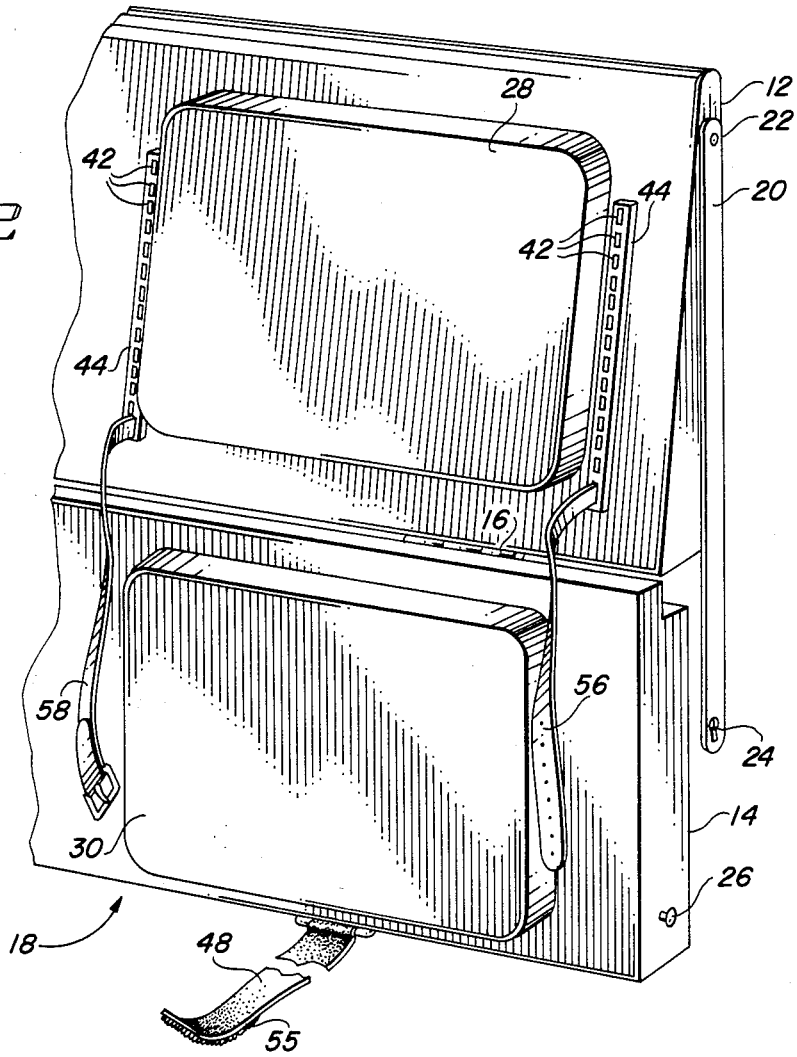
FIG. 2 is a partial close-up view of the right end of the assembly of the bench of FIG. 1, with the tray removed and the bench in the stowage position.
Figure 3:
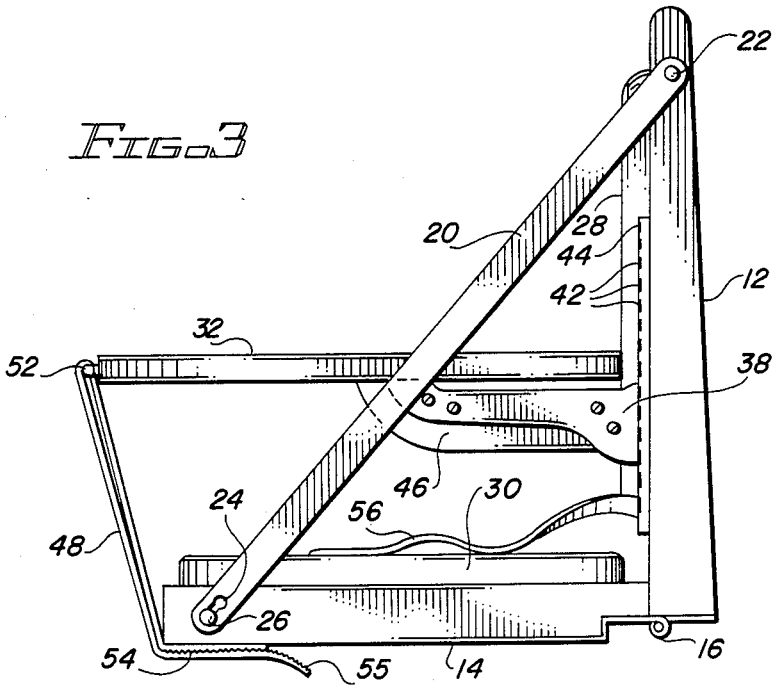
FIG. 3 is a side view of the right end of the assembly of FIG. 1.

As shown in FIGS. 1–3, an example multiple person tray seat in the form of a high chair bench 10 embodiment the principles of the present invention comprises a back 12 and a bottom 14, pivotally connected to each other by means of hinges 16 and presenting a plurality of seating places 18. The bottom 14 is connected to the back 12 so that it can be moved between a horizontal operational position (FIG. 3 and solid lines in FIG. 1) and a vertical stowage position (FIG. 2 and dot-and-dashed lines in FIG. 1).

Suitable means, such as a support bar 20, is provided to secure the bench seat bottom 14 at a right angle to the bench seat back 12. The support bar 20 is pivotally attached at one end by a fastener 22 to a point near the top of the side of the back 12. At its other end, the bar 20 is releasably attached at a point near the front of the side of bottom 14 to maintain the bench 10 in its operational position with the bottom 14 at right angle to the back 12 (FIG. 3). A simple releasable connection has a keyhole slot 24 formed in the lower end of the support bar 20 that is configured to bring it over a stud or similar fitting 26 positioned at the front of the side edge of the bottom 14. The slot 24 lifts off the stud 26 to permit the bottom 14 to drop down into stowage position against the wall below the back 12 as shown in FIG. 2. The pivotal attachment 22 of the support bar 20 to the back 12 permits the bar 20 to drop down into a nonobstructing position against the wall when the bench 10 is in its stowage position.

As shown in FIG. 1, the bench 10 is outfitted with two identical support bars 20, one at each end. It will be appreciated that the advantages and simplicity of the use of the support bar 20 arrangement as a means to secure the bench 10 in its operational position will be achieved for reversed positions of the pivotal attachment 22 and the removable connection 24, 26. The shown arrangement is however, preferred because of the way the rod 20 drops into a superior stowage position.

Each seating place 18 on bench 10 may be provided with a back cushion 28 and a bottom cushion 30. These elements serve for comfort of the person sitting at each place 18, so are selected accordingly. Though loose back and bottom cushions may be used, and other choices of upholstery may be made, for nursery and day-care center use the cushions 28, 30 are advantageously plastic covered foam pads secured at corresponding spaced-apart positions along the back 12 and the bottom 14, as shown in FIG. 1. Their shapes and covering material colors and designs can be chosen to make them visually pleasing and inviting for the children. Rounding of the corners (see FIG. 2) helps to lengthen wear.

Figure 4:
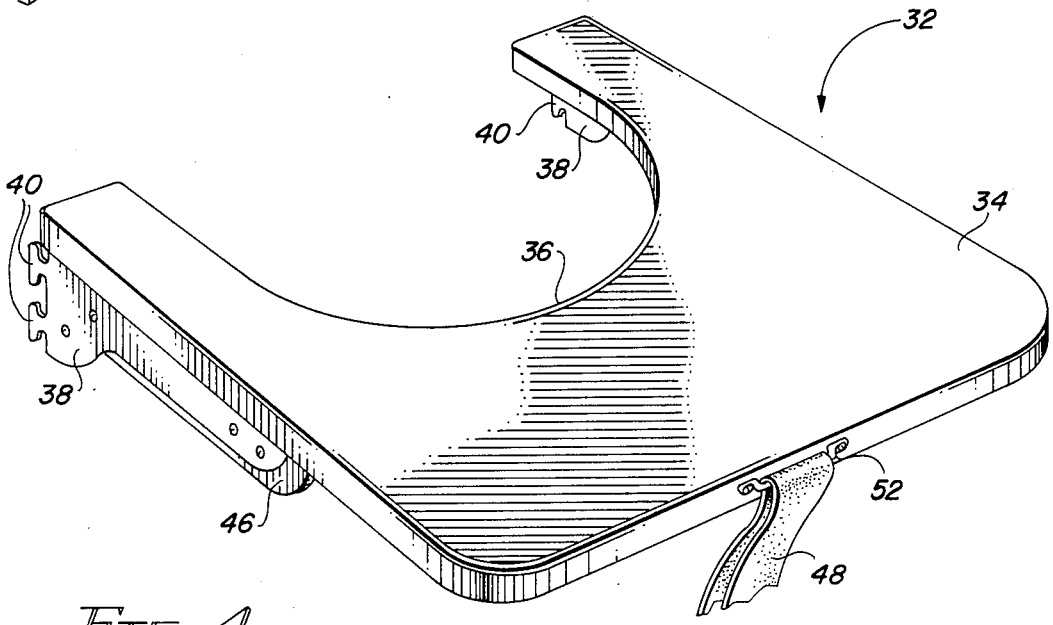
FIG. 4 is a perspective view of a tray of FIG. 1.

Means is provided to receive a tray 32 at each seating location 18. For children's use, the trays 32 preferably take the form (as shown in FIG. 4) of a planar eating-/working surface 34 having an oval cutout 36 into which the front torso of the child can be fit with the sides of the tray 32 extending around the sides of the child. Such cutouts are typical of high chair trays and serve, together with the high chair seat back 12, to confine the child and bring the tray close in order to minimize spillage. The surface 34 of tray 32 is shown as flat in the drawings. It may, however, be provided with a raised peripheral edge or other similar features, in accordance with individual preference and intended usage. Sharp corners or projections should preferably be rounded to minimize risk of injury to the seated child when the tray is inserted or to passersby when the tray in is place.

Each tray 32 includes a bracket 38 (See FIG. 4) located on each side below the work surface 34. The brackets 38 have vertically-spaced hooked ends 40 which fit into matching vertically-spaced slots 42 of perforated standards or tracks 44 which are mounted vertically on the bench back 12 in positions on each side of the back cushions 28 at each seating place 18. The trays 32 are mounted to the standards 44 by the brackets 38 in a similar fashion to the mounting of shelves to standards in the familiar bookshelf bracket-standard arrangement.

The elevation of the work surface 34 of each attached tray 32 is separately chosen for each seating place 18 in accordance with the requirements for the particular occupant of that seating place 18. For the high chair bench 10 example shown in FIGS. 1–4, the tracks 44 are long enough and have a sufficient number of perforations 42 (see FIG. 2) to permit positioning trays 32 at each place 18 at any one of several elevations, from a welcome low height for younger infants to a high elevation convenient for older toddlers. For a tray 32 (FIG. 4) made of wood, the brackets 38 can take the form of any of various commercially available shelf brackets, which may be accented or disguised as desired, such as with wooden tray side pieces 46, as shown.

Means, such as adjustable tie straps 48, are provided to secure the trays 32 in their chosen elevated positions. This is accomplished for the illustrated bracket-track arrangement by maintaining downward tension on the front of the tray 32 (see FIG. 3). To achieve this, a tie strap 48 is attached at one end to the underside of the seat bottom 14 below each seating place 18, and the free end of the strap 48 is wound around a handle 52 (FIG. 4) provided at the front of each tray 32 and fastened to the attached end by a releasable connection 54, such as a velcro TM hook and loop arrangement. The velcro TM piece 55 on the free end of strap 48 is made long enough to enable the desired tension to be achieved throughout the full range of selectable tray elevations. Attachment between the strap 48 and the bench bottom 14 can be by means of any suitable fastener, such as a screw which threads through the tie strap 48 into the bench bottom 12. To prevent a protruding fastener from marring the wall when the bottom 14 is lowered into the bench 10 stowage position, it may be desirable to provide a recess in the bench bottom 14 at the point of attachment.

To assist in restraining each seated child, a safety strap having a male member 56 and a matingly engaging female member 58 (FIGS. 1 and 2) is outfitted at each seating place 18. The strap pieces 56, 58 may be suitably fastened to the bench back 12, as shown in FIG. 2, by respectively securing them to the lowest perforations in the tracks 42, with the member 56 fastened to a track 44 on one side of each back cushion 28 and the member 58 fastened to a track 44 on the other side of each back cushion 28.

From the preceding description, it can be seen that the high chair bench 10 provides an orderly, compact multiple person tray seat which can be attached to a wall or other supporting surface for nonobstructing, convenient stowage when not in use and for ready convertibility to its operational position when needed. As described above, to bring the bench 10 from the stowage position (shown in FIG. 2 and by dot-and-dashed lines in FIG. 1) into the operational position (shown in FIG. 3 and by solid lines in FIG. 1), the seat bottom 14 hinged at its back to the base of the seat back 12 is raised up manually to a horizontal position, and secured in that position by bar 20 which is pivoted out from the wall to bring the keyhole-shaped slot 24 of bar 20 over the stud 26. Then, after persons have been seated at the places 18, trays 32 are attached at each place 18 by hooking the ends 40 of the brackets 38 on each side of the trays 32 at desired elevations into chosen corresponding apertures 42 of tracks 44 on the sides of each place 18. The free ends of the ties 48 are then wound around the handles 52 and secured to the attached ends at 54 to provide downward tension at the front of the trays 32 to keep the brackets 38 hooked into the tracks 44.

It will be appreciated that various substitutions and modifications may be made to the specific embodiment described, without departing from the spirit and scope of the present invention as defined by the claims appended hereto. In particular, the pivotal connection between the back 12 and the bottom 14 of the seat 10 can take other forms suitable for such pivotal joints. For example, webbing extending the length of the connection which is sufficiently strong to support the weight exerted by the bottom 14 when fully loaded with seated persons, can take the place of the hinges 16. Also, the support bar 20 may be replaced by other methods of releasably securing the bottom 14 at a right angle to the back 12. A brace, for example, located under the seat bottom could be folded out to abut at a supporting angle against the wall to which the back is attached. Other forms of attachment of the trays 32 to the back 12 or bottom 14 may be also used instead of the illustrated bracket-track attachment method. It will also be appreciated that other techniques may be used in place of tie 48 to secure the trays 32 in their desired elevational positions above the seat bottom. Tie 48 could, for example, be replaced by a tension member that utilizes a quick release clip of some kind. Moreover, the positions of the fixed and releasable connections of the tie 48 to the tray 32 and bottom 14 may be reversed, or otherwise changed, without sacrificing the advantages and benefits of the invention as claimed.

What is claimed is:

1. A multiple person tray seat for attachment to a wall or other support, comprising:

a seat back;

a seat bottom having a plurality of side-by-side seating places thereon and being pivotally connected to said seat back for movement between a first position perpendicular to said seat back and a second position substantially parallel to said seat back;

means for securing said seat bottom in said first position; and means for removably attaching a tray to said seat back at each side of each seating place at an independently selectable one of a plurality of elevations above said seat bottom first position, said means serving to place the tray into a seating place occupant confining position.

2. A seat as in claim 1, wherein said tray attaching means comprises a plurality of slotted tracks into which brackets of a tray can be fitted, said tracks being positioned so that there is a track located on each side of each of said seating places.

3. A seat as in claim 2, wherein said plurality of tracks comprises a plurality of elongated tracks mounted on said seat back perpendicular to said pivotal connection.

4. A seat as in claim 3, further comprising a safety strap at each seating place adapted to separately restrain a person seated at each said place.

5. A seat as in claim 4, wherein said safety strap comprises a male strap element secured to the track on one side of each seating place and a matingly engaging female strap element secured to the track on the other side of each seating place.

6. A seat as in claim 3, wherein said seat further comprises means to removably secure said brackets in said slotted tracks.

7. A seat as in claim 6, wherein said bracket securing means comprises, at each seating place, a strap and means for removably and adjustably connecting said strap between said seat bottom and a tray received at each said seating place.

8. A seat as in claim 1, wherein said seat back includes a back cushion at each of said seating places and said seat bottom includes a bottom cushion at each of said seating places.

9. A seat as in claim 1, wherein said seat bottom securing means comprises a support member attached to one of said seat back and seat bottom, and means for removably connecting said support member to the other of said seat back and seat bottom.

10. A seat as in claim 9, wherein said seat bottom securing means further comprises a stud located on said one of said seat back and seat bottom, and a support bar pivotally attached to said other of said seat back and seat bottom and having a keyhole opening for removable attachment to said stud.

11. A multiple person tray seat for attachment to a wall or other support, comprising:

a seat back;

a seat bottom having a plurality of side-by-side seating places thereon and being pivotally connected to said seat back for movement between a first position perpendicular to said seat back and a second position substantially parallel to said seat back;

means for securing said seat bottom in said first position;

a plurality of trays, each having a rear cutout; and means removably attaching one of said trays to said seat back at each side of each seating place at an elevation above said seat bottom first position, so that the tray cutout extends around to the sides of a seating place occupant to confine and bring the tray close to the occupant.

12. A seat as in claim 11, wherein said tray attaching means comprises means removably attaching one of said trays at each seating place at an independently selectable one of a plurality of elevations above said seat bottom first position.

13. A seat as in claim 11, wherein said trays include brackets and wherein said tray attaching means comprises slotted tracks located on each side of each of said seating places into which said brackets can be removably fitted.

14. A seat as in claim 13, wherein said seat further comprises means to removably secure said brackets in fitted positions within said slotted tracks.

15. A seat as in claim 14, wherein said bracket securing means comprises, at each seating place, a strap and means removably connecting said strap between said seat bottom and a respective tray.

16. A seat as in claim 15, wherein said connecting means comprises means for removably connecting said strap in tension between the front of said seat bottom and the front of said tray.

17. A high chair bench assembly for attachment to a wall or other support, and having a plurality of side-by-side child seating places thereon, comprising:

a vertical bench back having a back cushion located at each seating place;

a bench bottom having a bottom cushion located at each seating place, said bench bottom being hingedly connected to said bench back for movement between a horizontal position and a vertical position;

a support member attached to one of said bench back and bench bottom;

means for removably connecting said support member to said other of said bench back and bench bottom to secure said bench bottom in said horizontal position;

slotted elongated tracks running vertically on said bench back in positions so that there is a track located on each side of each seating place; and a plurality of trays having rear cutouts and being configured to be respectively removably received in said slots of said tracks on the sides of each seating place in an elevated position above said bench bottom horizontal position in the manner of a high chair tray with the cutout extending around to the sides of a person seated in said place.

18. An assembly as in claim 17, wherein said trays include brackets cooperating with said tracks so that the tray at each seating place can be independently selectively brought into any of a plurality of elevations above said bench bottom.

19. An assembly as in claim 18, further comprising tension means at each seating place for removably and adjustably connecting the front of each tray with the front of said bench bottom, to secure said tray brackets relative to said tracks.

20. An assembly as in claim 19, further comprising a safety strap at each seating place, with each said strap comprising a male strap element secured to the track on one side of each seating place and a matingly engaging female strap element secured to the track on the other side of each seating place.

* * * * *